United States Patent [19]

Uehara

[11] Patent Number: 4,723,926

[45] Date of Patent: Feb. 9, 1988

[54] NON-VIBRATING STRUCTURE OF AN OUTBOARD MOTOR

[75] Inventor: Hidehiko Uehara, Hamamatsu, Japan

[73] Assignee: Sanshin Kogyo Kabushiki Kaisha, Japan

[21] Appl. No.: 851,935

[22] Filed: Apr. 14, 1986

[30] Foreign Application Priority Data

May 14, 1985 [JP] Japan ..... 60-100564

[51] Int. Cl.[4] ..... B63H 1/15

[52] U.S. Cl. ..... 440/52; 440/76

[58] Field of Search ..... 440/52, 88, 89, 76, 440/900; 181/207, 208

[56] References Cited

U.S. PATENT DOCUMENTS

| | | | |
|---|---|---|---|
| 3,002,489 | 10/1961 | Watkins | 440/52 |
| 3,045,423 | 7/1962 | Hulsebus | 440/89 |
| 3,750,615 | 8/1973 | Haft et al. | 440/52 |
| 3,918,530 | 11/1975 | Nyholm | 181/207 |

*Primary Examiner*—Sherman D. Basinger
*Assistant Examiner*—Jesûs D. Sotelo
*Attorney, Agent, or Firm*—Ernest A. Beutler

[57] ABSTRACT

An outboard drive arrangement having a drive shaft housing having spaced walls defining a hollow interior. An exhaust pipe extends into the hollow interior and resilient elements are interposed between the exterior walls of the exhaust pipe and the interior walls of the drive shaft housing for providing a resilient connection therebetween for damping vibrations.

12 Claims, 5 Drawing Figures

NON-VIBRATING STRUCTURE OF AN OUTBOARD MOTOR

BACKGROUND OF THE INVENTION

This invention relates to an arrangement for providing a non-vibrating structure for an outboard motor and more particularly to an improved and simplified arrangement for damping vibrations and preventing their emanation from the drive shaft housing of an outboard drive.

In both the outboard drive portion of an inboard/outboard drive and in the drive shaft housing of an outboard motor, the drive shaft housing is normally formed from a unitary, generally hollow casing. The opposite side walls of this casing can act as resonant devices which will amplify the sounds and vibrations generated by the other components of the outboard drive unit. Normally, the drive shaft housing is provided with a hollow interior that forms an expansion chamber that is utilized in conjunction with the silencing of the exhaust gases of the associated powering internal combustion engine. The exhaust gases are delivered to this expansion chamber through an exhaust pipe that extends into the drive shaft housing for expansion and discharge to the atmosphere through an under water exhaust gas outlet. The pulsations of the exhaust gases are one of the sources of sound which will cause the side walls of the drive shaft housing to vibrate and amplify the generated noises. In addition, the exhaust pipe itself is normally not supported, except at its upper end, and it itself can vibrate and transmit noises back through its supporting plate to the atmosphere.

Various arrangements have been employed for attempting to silence these noises, however, they are generally quite complicated and add significantly to the cost and weight of the unit.

It is, therefore, a principal object of this invention to provide an improved, simplified and low cost arrangement for reducing the amount of noise generated by the drive shaft housing of an outboard drive.

It is a further object of this invention to provide an improved arrangement for reducing sound transmission from a drive shaft housing.

It is a yet further object of this invention to provide an improved arrangement for preventing vibrations of the walls of the drive shaft housing and for damping vibrations of an exhaust pipe that extends into the drive shaft housing.

SUMMARY OF THE INVENTION

This invention is adapted to be embodied in an outboard drive that comprises a drive shaft housing consisting of an outer casing defining a generally hollow interior. The drive shaft passes through and is rotated within the drive shaft housing. An exhaust pipe extends in the hollow interior of the drive shaft housing for discharging exhaust gases thereinto. In accordance with the invention, resilient means are interposed between the exterior surface of the exhaust pipe and an adjacent wall of the drive shaft housing for resiliently maintaining the spacing therebetween and for resisting the vibration thereof.

DETAILED DESCRIPTION OF THE PREFERRED EMBODIMENT

Figure 1:
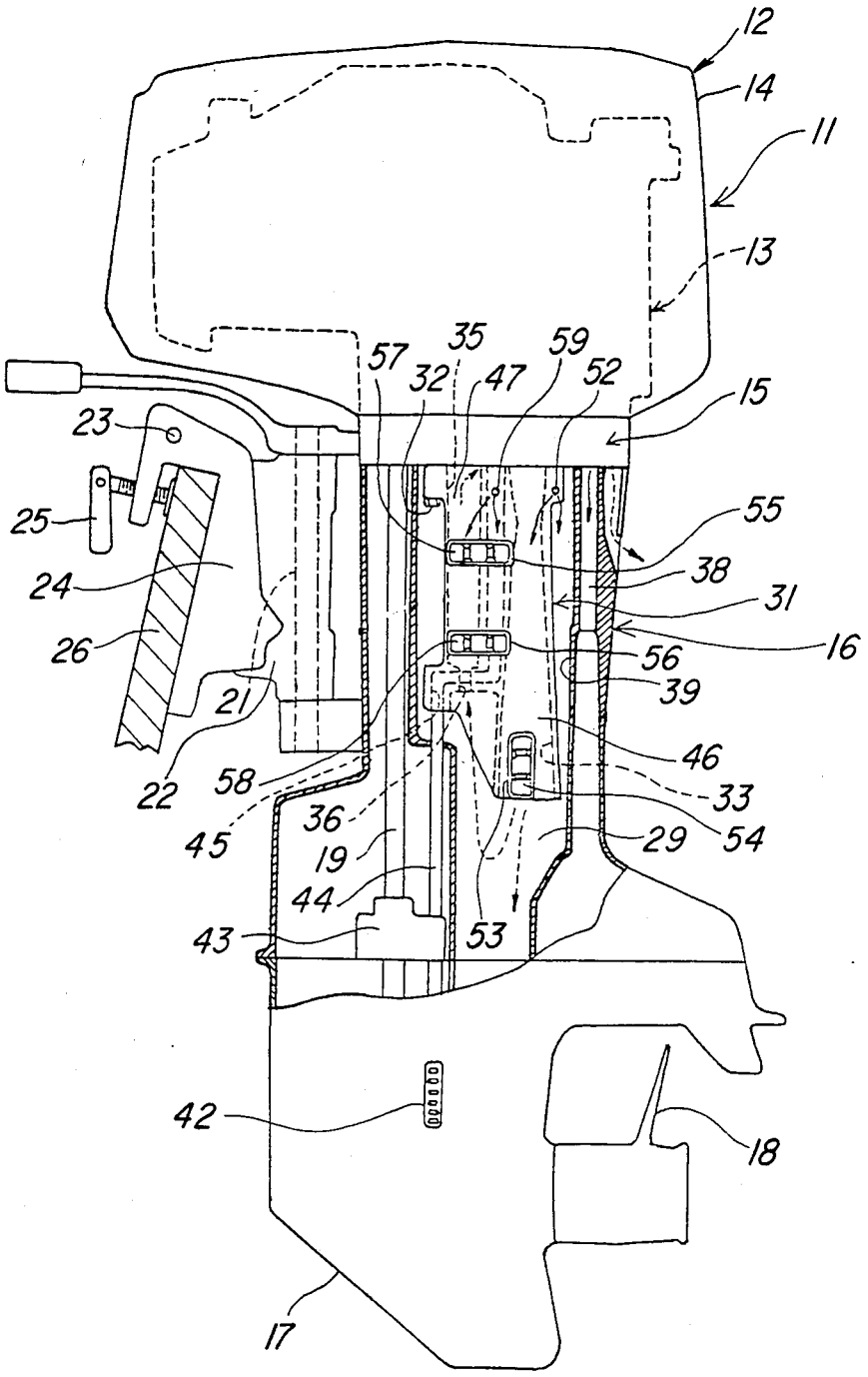
FIG. 1 is a side elevational view, with portions broken away, of an outboard motor constructed in accordance with an embodiment of the invention.
Figure 2:
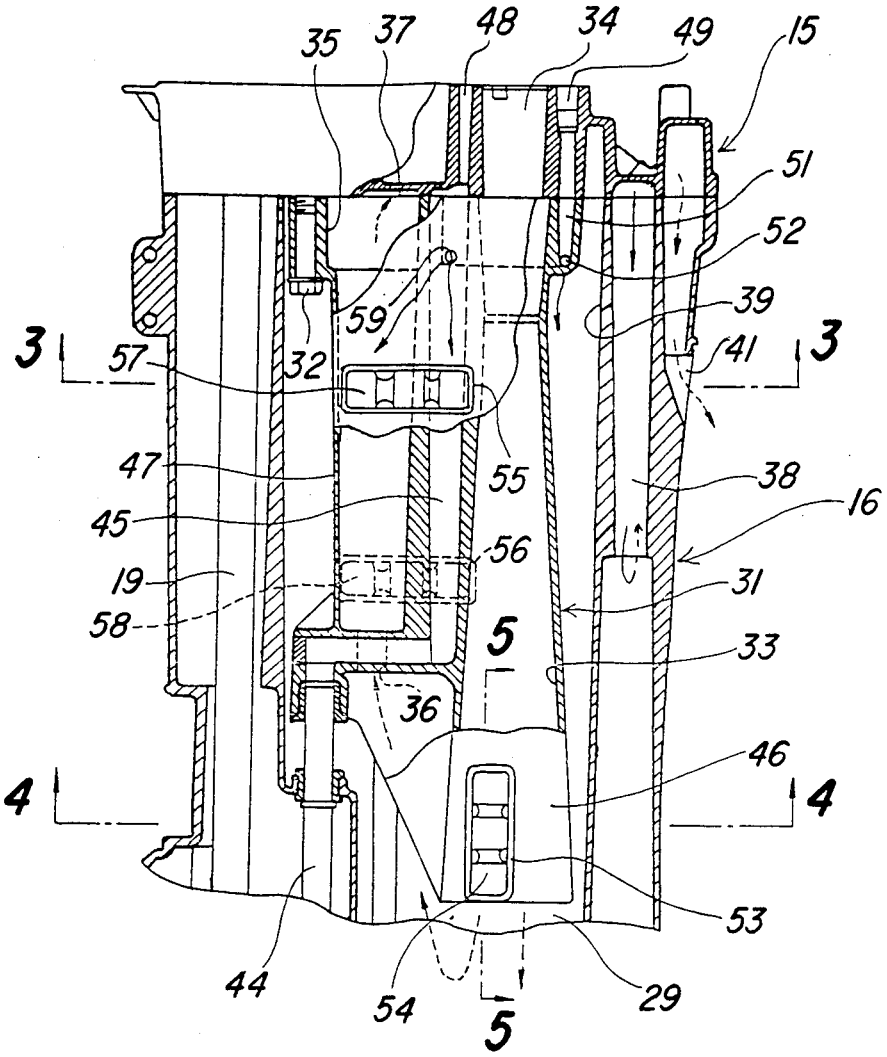
FIG. 2 is an enlarged side elevational view showing the drive shaft housing, with portions broken away.
Figure 3:
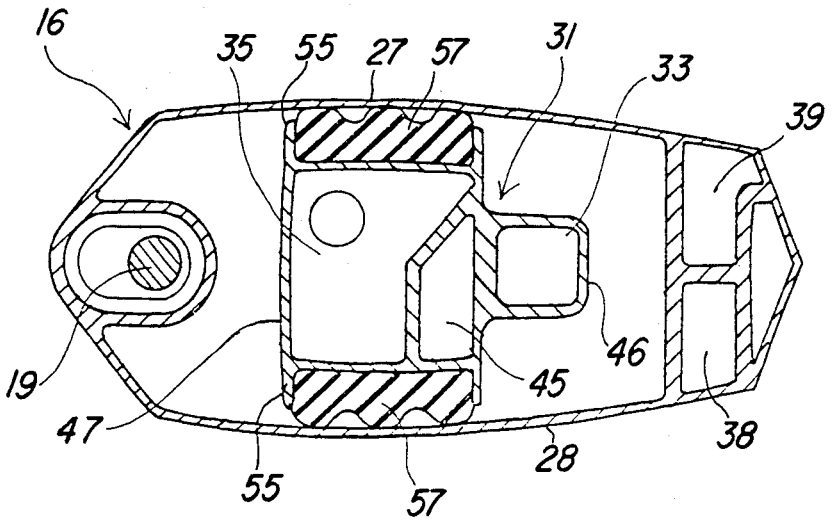
FIG. 3 is a cross-sectional view taken along the line 3—3 of FIG. 2.

Referring first to FIG. 1, an outboard motor constructed in accordance with an embodiment of the invention is identified generally by the reference numeral 11. The outboard motor 11 includes a power head, indicated generally by the reference numeral 12 and comprising an internal combustion engine 13 and a surrounding protective cowling 14. The engine 13 may be of any known type and may be comprised of a two-cycle, crankcase compression engine. It is to be understood, however, that the invention may be utilized in conjunction with other engines and may, in fact, be utilized in conjunction with the outboard drive unit of an inboard/outboard drive. However, the invention has particular utility in conjunction with outboard motors.

The engine 13 is supported upon a spacer plate 15 which is, in turn, affixed to the upper end of a drive shaft housing, indicated generally by the reference numeral 16. Affixed to the lower end of the drive shaft housing 16 is a lower unit 17 that contains a forward, neutral, reverse transmission for driving a propeller 18. The transmission is driven by means of a drive shaft 19 that is driven by the output shaft of the engine 13 and which extends through the drive shaft housing 16 and terminates in the lower unit 17.

A steering shaft 21 is affixed to the drive shaft housing 16 and is journaled within a swivel bracket 22 for steering of the motor 11 about a generally vertically extending steering axis. The swivel housing 22 is connected by means of a pivot pin 23 to a clamping bracket 24. The pivot pin 23 permits tilting movement of the outboard motor 11 relative to the clamping bracket 24.

The clamping bracket 24 carries a clamping device 25 for attachment of the outboard motor 11 to a hull 26 of an associated watercraft, which is shown only partially.

Referring now additionally to the remaining figures, the drive shaft housing 16 is formed, as has been noted, from a single piece, light metal casting and is made up of an outer shell comprising a pair of spaced apart walls 27 and 28 that are connected to each other integrally at their forward and rearward ends. These walls 27 and 28 define an expansion chamber 29 of substantial volume that extends vertically throughout the height of the drive shaft housing 16. The expansion chamber 29 is employed for silencing the exhaust gases discharged from the engine 13 and for this purpose, an exhaust pipe, indicated generally by the reference numeral 31 is affixed to the spacer plate 15 by means of threaded fasteners 32. The exhaust pipe 31 is provided with a vertically extending exhaust passage 33 which terminates at its lower end in the expansion chamber 29. At its upper end, the passage 33 communicates with an exhaust passage 34 that is formed in the spacer plate 15. The spacer plate exhaust passage 34 commumicates with the exhaust outlet of the engine 13 in a known manner.

The outboard motor 11 is provided with an underwater high speed exhaust gas discharge (not shown) from which the exhaust gases may be discharged after they have expanded in the expansion chamber 29. Typically, the motor 11 may employ a through the propeller exhaust gas discharge and since the method of high speed exhaust gas discharge forms no part of the invention, it has not been illustrated. Those skilled in the art can really determine how the invention can be practiced with any of the known types of underwater exhaust gas discharges.

When the outboard motor 11 is operating at low speeds, the underwater exhaust gas discharge will be relatively deeply submerged and this coupled with the low pressure of exhaust gas under this running condition makes it necessary to provide an above the water exhaust gas discharge. In order to provide silencing for the above the water exhaust gas discharge, there is provided a second expansion chamber 35 which is formed at least in part in the body of the exhaust pipe 31. Exhaust gases from the expansion chamber 29 may flow through a restricted passageway 36 into the expansion chamber 35 wherein they will expand. Successive contraction and expansion is effective to provide silencing for the exhaust gases.

From the expansion chamber 35, the slow speed exhaust gases flow through a passage 37 formed in the spacer plate 15 to a third expansion chamber 38 formed in the drive shaft housing between a vertical wall 39 and the rear face of the drive shaft housing. From the expansion chamber 38, the exhaust gases flow through a tortuous path 39 formed in the drive shaft housing 16 and spacer plate 15 for discharge to the atmosphere through an above the water exhaust gas discharge opening 41. In this way, the slow speed exhaust gases will be effectively silenced by the successive expansions and contractions.

The system is also provided for cooling the engine 13 of the outboard motor 11. This system includes a cooling water inlet 42 that is formed in the lower unit 17 and through which cooling water is drawn from the body of water in which the outboard motor 11 is operating. The water is drawn in by way of a coolant pump 43 that is mounted at the interface between the lower end of the drive shaft housing 16 and the lower unit 17 and is driven by the drive shaft 19 in a known manner. This coolant is delivered from the pump 43 under pressure through a conduit 44 to a vertically extending coolant passage 45 formed in the exhaust pipe 31. In this regard, it should be noted that the exhaust pipe 31 is formed of a first, rearward section 46 in which the exhaust passage 33 is formed and a forward portion 47 in which the expansion chamber 35 and coolant passage 45 are formed.

The coolant is delivered upwardly from the coolant passage 45 to the engine cooling system through a vertically extending passage 48 formed in the spacer plate 15. The passage 48 communicates with the cooling jacket of the engine 13 in a known manner. Coolant is then circulated through the cooling jacket and is returned back to the drive shaft housing 16 through a return passage 49 formed in the spacer plate. The lower end of the passage 49 communicates with a coolant chamber 51 formed in the upper end of the exhaust pipe 31 for providing cooling for the exhaust gases. This coolant is then discharged through the lower unit by means of a return opening 52 formed at the lower end of the chamber 51. It should be noted that the outlet 52 is disposed so that the coolant discharge will flow over the exhaust pipe 31 and cool it.

It should be noted from the construction as thus far described that the drive shaft housing side walls 27 and 28 are spaced apart a significant distance and thus could form resonant devices for amplifying noise. In addition, in the arrangement as thus far described, the exhaust pipe 31 is cantilevered within this chamber and it also can resonate. An arrangement now to be described is provided for insuring against such resonance.

Figure 4:
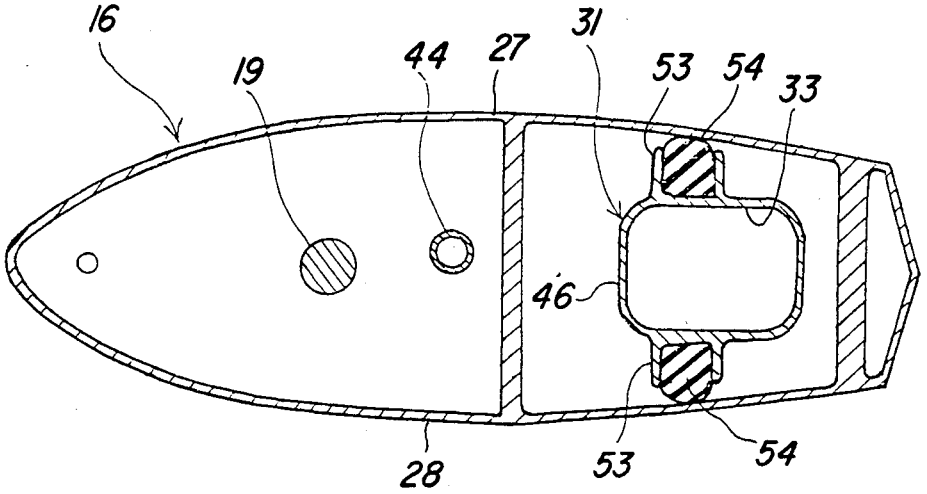
FIG. 4 is a cross-sectional view taken along the line 4—4 of FIG. 2.
Figure 5:
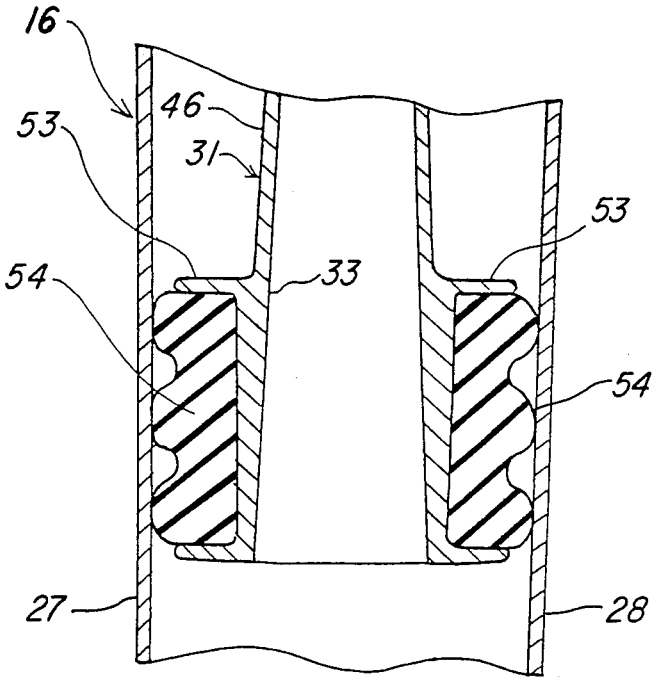
FIG. 5 is a cross-sectional view taken along the line 5—5 of FIG. 2.

The lower end of the exhaust pipe portion 46 is provided, on each of its opposite sides, with a raised rib 53 in which an elastomeric member 54 is received. The elastomeric members 54 are compressed within the ribs 53 and thus retained in place. The elastomeric members 54 are configured, as shown in FIGS. 4 and 5, so that they will engage the inner periphery of the drive shaft housing walls 27 and 28 so as to provide a resilient interconnection between them and the exhaust pipe 31.

In a similar manner, the opposite sides of the exhaust pipe portion 47 are each provided with upper and lower ribs 55 and 56 in which elastomeric members 57 and 58 are compressed. The elastomeric members 57 and 58 are in compression engagement with the inner surfaces of the walls 27 and 28 so as to provide a resilient connection between them and the exhaust pipe 31. Thus, it should be readily apparent that a resilient connection is provided between the walls 27 and 28 through the elastomeric members 54, 57 and 58 and the exhaust pipe 31 so as to effectively dampen any vibrations.

The elastomeric members 57 and 58 are cooled by cooling water that is discharged through a pair of opposed passages 59 formed in the coolant chamber 45 which flow of coolant also serves to cool the exhaust pipe 31. The coolant flowing from the passage 52 will also serve to cool the elastomeric member 54. Therefore, it should be readily apparent that the disclosed device very effectively dampens vibrations in a simple manner. It should be noted that the inner walls 27 and 28 of the drive shaft housing diverge upwardly so that the exhaust pipe 31 with the elastomeric members 54, 57 and 58 in place can be conveniently inserted into it on assembly.

Although an embodiment of the invention has been illustrated and described, various changes and modifications may be made without departing from the spirit and scope of the invention, as defined by the appended claims.

What is claimed is:

1. In an outboard drive comprising a drive shaft housing comprising an outer casing defining a generally hollow interior, a drive shaft passing through and rotatable in said drive shaft housing, and an exhaust pipe extending into the hollow interior of said drive shaft housing, the improvement comprising said outer casing and said exhaust pipe having facing, vertically extending walls, resilient means loaded in compression transversely between the vertically extending wall of said exhaust pipe and the adjacent vertically extending wall of said drive shaft housing for resiliently maintaining the spacing in the transverse direction therebetween.

2. In an outboard drive as set forth in claim 1 wherein one of the exhaust pipe and adjacent wall have an outstanding rib in which the resilient means is compressingly engaged.

3. In an outboard drive as set forth in claim 2 wherein the rib is formed on the exhaust pipe.

4. In an outboard drive as set forth in claim 3 wherein the walls of the drive shaft housing are tapered for insertion of the exhaust pipe and resilient means therein.

5. In an outboard drive as set forth in claim 4 further including means for delivering engine coolant to the resilient means for cooling the resilient means.

6. In an outboard drive as set forth in claim 5 wherein the coolant is delivered to the wall of the exhaust pipe for cooling the exhaust pipe.

7. In an outboard drive as set forth in claim 1 wherein there are provided a pair of resilient means each positioned between a respective opposing side of the exhaust pipe and a corresponding facing side of the drive shaft housing.

8. In an outboard drive as set forth in claim 7 wherein one of the exhaust pipe and adjacent wall have an outstanding rib in which the resilient means is compressingly engaged.

9. In an outboard drive as set forth in claim 8 wherein the rib is formed on the exhaust pipe.

10. In an outboard drive as set forth in claim 9 wherein the walls of the drive shaft housing are tapered for insertion of the exhaust pipe and resilient means therein.

11. In an outboard drive as set forth in claim 10 further including means for delivering engine coolant to the resililent means for cooling the resilient means.

12. In an outboard drive as set forth in claim 11 wherein the coolant is delivered to the wall of the exhaust pipe for cooling the exhaust pipe.

* * * * *